United States Patent [19]

Antoni et al.

[11] Patent Number: 4,874,083

[45] Date of Patent: Oct. 17, 1989

[54] SERVING TRAY AND COVER THEREFOR

[75] Inventors: Patricia A. Antoni, Wheeling; Timothy J. Nolan, Streamwood; Thomas J. Hayes, Wauconda; Theodore R. Arneson, Mt. Prospect; Jerry E. Coleman, Wheeling, all of Ill.

[73] Assignee: Packaging Corporation of America, Evanston, Ill.

[21] Appl. No.: 162,419

[22] Filed: Mar. 1, 1988

[51] Int. Cl.[4] ..... B65D 25/00

[52] U.S. Cl. ..... 206/45.32; 206/45.31; 206/45.34; 206/557; 206/564; 229/2.5 R; 220/20

[58] Field of Search ..... 206/45.32, 45.34, 551, 206/557, 564, 45.31; 220/20, 83; 229/2.5 R

[56] References Cited

U.S. PATENT DOCUMENTS

| | | | |
|---|---|---|---|
| Re. 28,059 | 6/1974 | Mounts et al. . | |
| D. 290,232 | 6/1987 | Holzkopf . | |
| 695,763 | 3/1902 | Pichereau | 206/565 |
| 2,246,695 | 6/1941 | Phillips . | |
| 3,104,776 | 9/1963 | Bostrom | 229/2.5 R |
| 3,121,507 | 2/1964 | Weiss | 229/2.5 |
| 3,151,799 | 10/1964 | Engles, Jr. et al. | 229/2.5 |
| 3,172,768 | 3/1965 | Joosten et al. | 206/45.34 |
| 3,303,964 | 2/1967 | Luker . | |
| 3,398,827 | 8/1968 | Laskin | 206/551 |
| 3,848,795 | 11/1974 | Bird et al. | 206/45.32 |
| 3,912,118 | 10/1975 | Bird . | |
| 4,197,940 | 4/1980 | DeRossett | 206/45.32 |
| 4,206,845 | 6/1980 | Christian | 229/2.5 |
| 4,375,862 | 3/1983 | Kurinsky . | |
| 4,555,024 | 11/1985 | Voss et al. | 206/564 |
| 4,741,452 | 5/1988 | Holzkopf | 206/45.32 |

FOREIGN PATENT DOCUMENTS

| | | | |
|---|---|---|---|
| 303689 | 12/1932 | Italy | 220/20 |

OTHER PUBLICATIONS

Ekco Products, Inc.-Advertising Brochure (Date Unknown).

*Primary Examiner*—David T. Fidei

*Attorney, Agent, or Firm*—Neuman, Williams, Anderson & Olson

[57] ABSTRACT

A serving tray is provided for use with a removable cover. The tray is provided with a rim section having a laterally extending ledge portion and a skirt portion depending therefrom. The skirt portion having upper edge segments spaced from the underside of the ledge portion and cooperating therewith to form substantially rigid marginal lips. Cooperating with the tray is a removable cover having an upright wall section encompassing and depending from a top section. The lower edge of the wall section terminates in an outwardly extending first flange. A yieldable second flange extends downwardly and outwardly from the first flange and portions of the second flange cooperate therewith to form a plurality of pockets encompassing and lockingly accommodating the tray lips when said tray and cover are in assembled relation.

20 Claims, 2 Drawing Sheets

FIG. 1
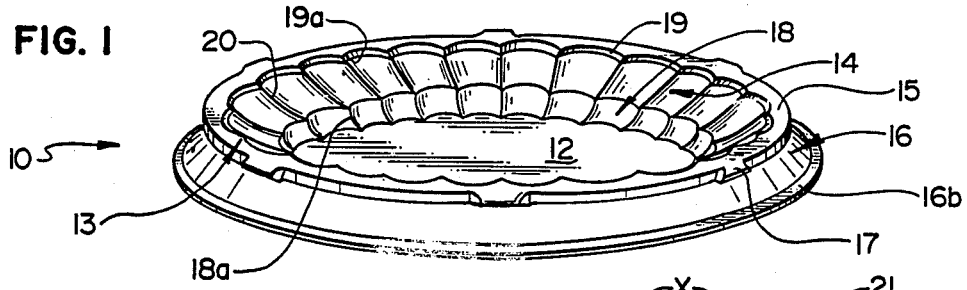
FIG. 2
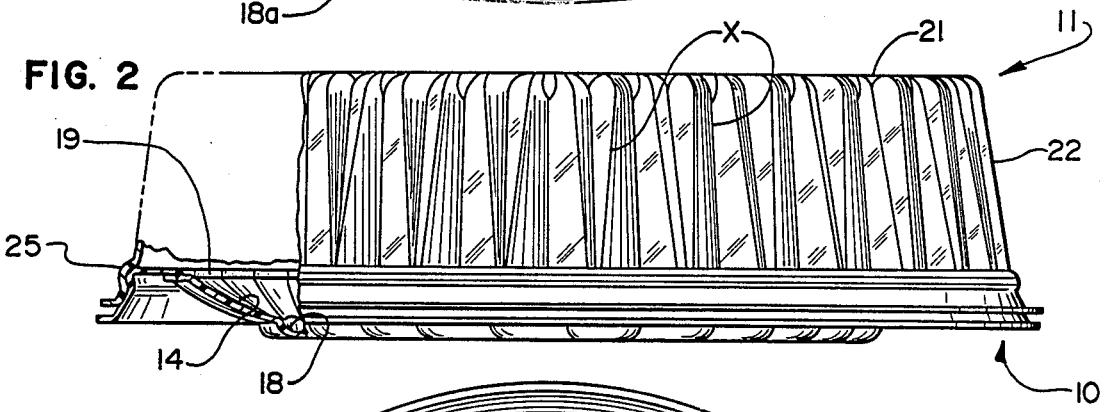
FIG. 3
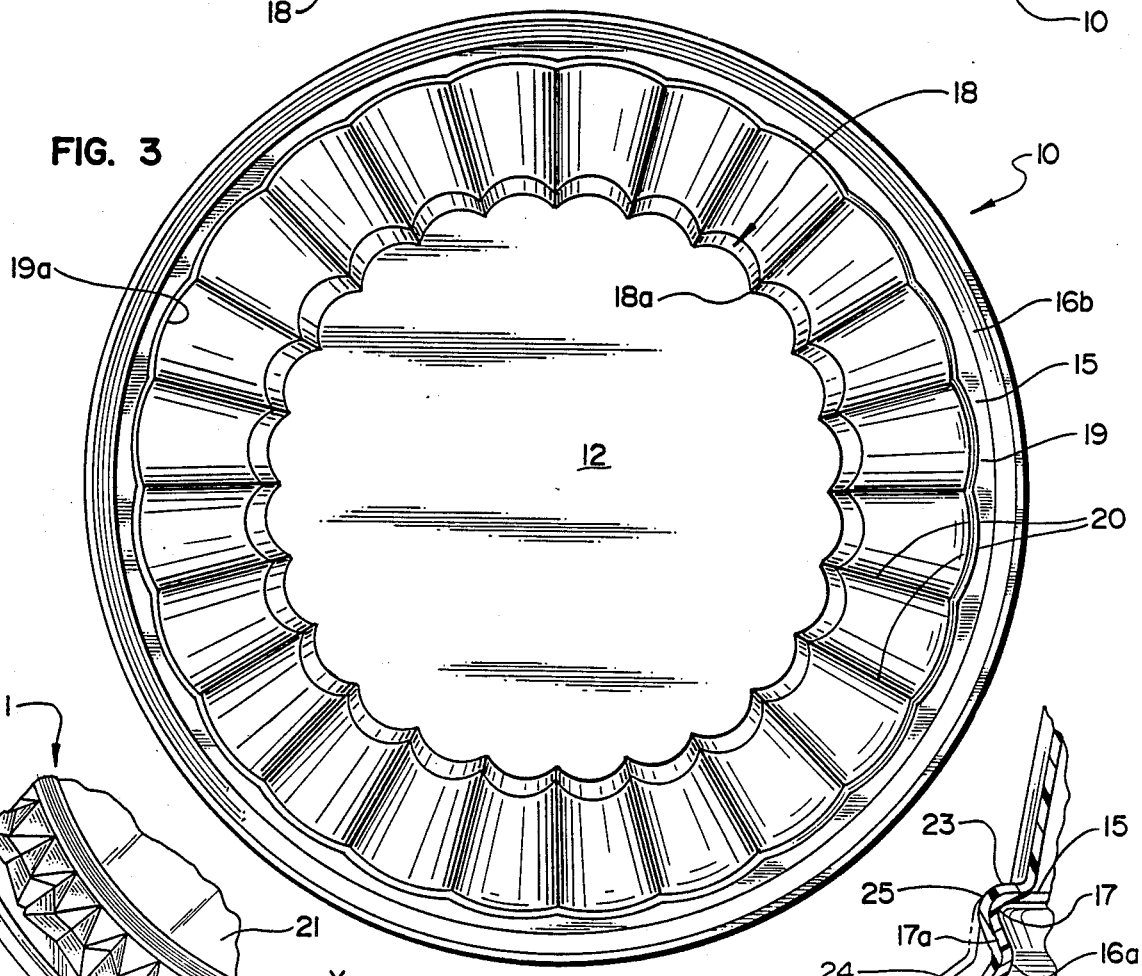
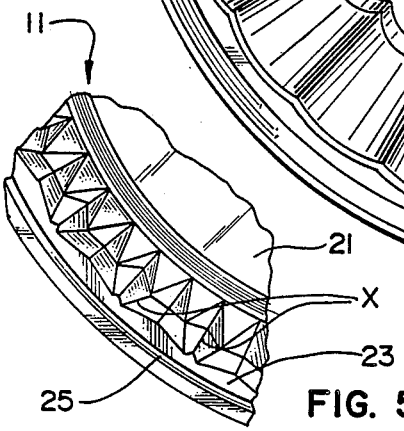
FIG. 5
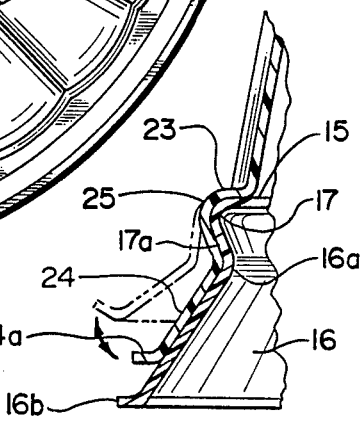
FIG. 4

SERVING TRAY AND COVER THEREFOR

BACKGROUND OF THE INVENTION

The use of inexpensive serving trays and covers therefor has become popular for dispensing and serving various food products such as cold cuts, cheese, chip dips, raw vegetables and the like. Such food products are commonly referred to as "deli food." The prior trays and covers, however, are beset with one or more of the following shortcomings: (a) such trays and covers are weak and unstable and do not provide the desired support and protection for the accommodated products; (b) assembly and disassembly of the tray and cover are awkward and frustrating manipulations; (c) the tray and cover have an unattractive appearance; and (d) the tray and cover are not capable of accommodating a wide variety of products.

SUMMARY OF THE INVENTION

Thus, it is an object of the invention to provide an improved tray and cover therefor which avoid the aforementioned shortcomings associated with the prior art.

It is a further object to provide a tray and cover therefor which are formed of thin gauge inexpensive plastic material and yet, said tray and cover are possessed of an inordinate amount of strength and stability.

Further and additional objects will appear from the description, accompanying drawings and appended claims.

In accordance with one embodiment of the invention, a serving tray of thin gauge plastic material is provided on which a cover is removably mounted. The tray includes a center section, a rim section in spaced encompassing relation therewith and an intermediate section interconnecting the center and rim sections. The rim section includes a ledge portion and a skirt portion depending from the outer periphery of the ledge portion. The skirt portion has a predetermined upper edge segment which is spaced from the underside of the ledge portion and is recessed from the outer periphery thereof. The predetermined segment of the skirt upper edge coacts with the ledge portion outer periphery to form a substantially rigid marginal lip. The lip is lockingly engaged by a yieldable, encompassing pocket formed on the cover when the latter and the tray are in assembled relation.

DESCRIPTION

For a more complete understanding of the invention, reference is made to the drawings wherein:

FIG. 1 is a perspective top view of one embodiment of the improved serving tray.

FIG. 2 is a side elevational view partially in vertical section through a marginal lip of the tray of FIG. 1 and showing the improved cover assembled thereon.

FIG. 3 is a bottom view of the tray of FIG. 1.

FIG. 4 is an enlarged fragmentary sectional view showing the interlocking relation between the cover and tray; the locking flange of the cover shown in phantom lines in an unlocked position relative to the marginal lip of the serving tray.

FIG. 5 is an enlarged fragmentary top plan view of the cover of FIG. 2.

Figure 6:
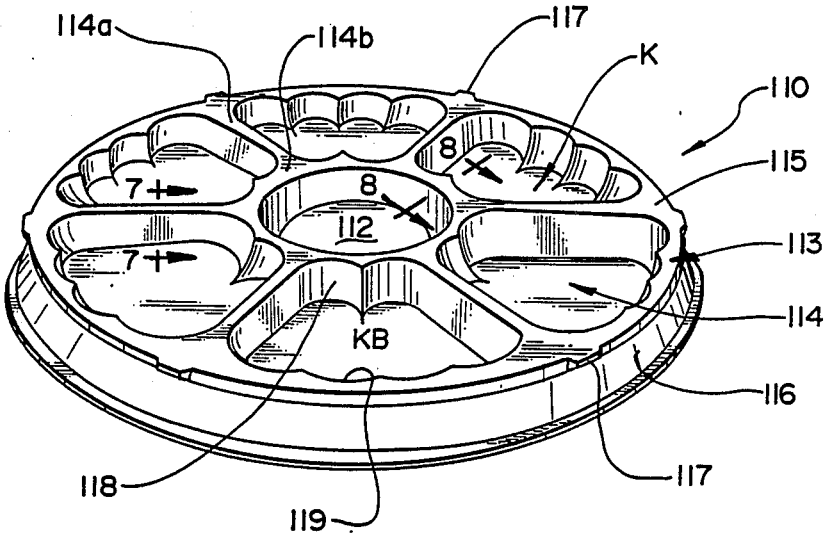
FIG. 6 is a perspective top view of a second embodiment of the improved serving tray.
Figure 7:
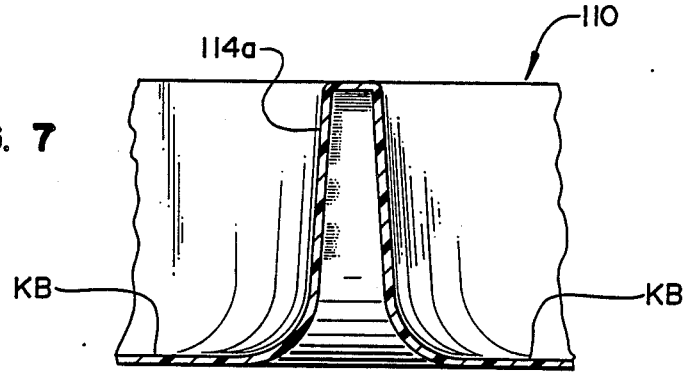
Figure 8:
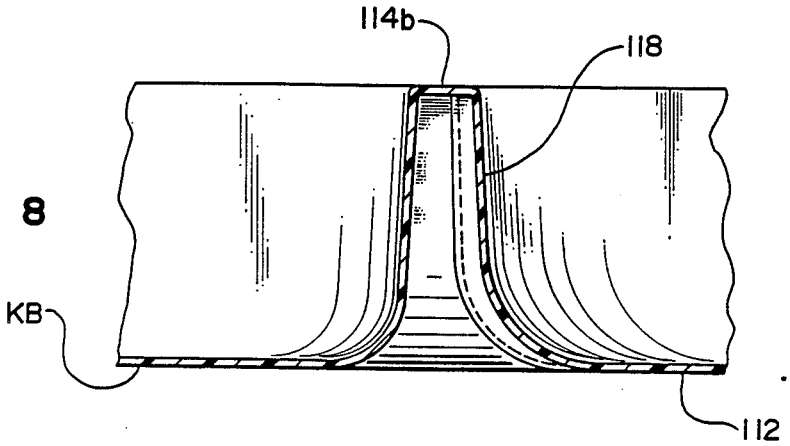

FIGS. 7 and 8 are enlarged fragmentary sectional views taken respectively, along lines 7—7 and 8—8 of FIG. 6.

Referring now to the drawings and more particularly to FIG. 2 one embodiment of the improved serving tray 10 and a cover 11 are shown in assembled relation. The tray 10, shown more clearly in FIGS. 1 and 3, is preferably formed of a thin gauge (e.g. 0.010"–0.030") plastic material (e.g. polystyrene) which is vacuum formed to the desired shape. While the tray 10, as illustrated is of circular configuration, the invention herein disclosed is not intended to be limited thereto but may take various other geometric shapes (e.g. square, rectangular, semicircular, oval, etc.)

The cover 11 is preferably vacuum formed from a sheet of thin gauge plastic material similar to that used in forming the tray; except, the tray material is preferably opaque and may be a variety of colors or color combinations. The cover 11, on the other hand, is preferably transparent, so that the customer can ascertain what the accommodated product is and the condition thereof without having to remove the cover.

Tray 10, as seen in FIG. 1, includes a center section 12, a rim section 13, and an intermediate section 14 which interconnects the center and rim sections. The rim section is provided with an annular substantially planar ledge portion 15 which is elevated relative to the plane of center section 12 and is concentrically disposed with respect thereto. Extending downwardly and outwardly from the outer periphery of ledge portion 15 is a skirt portion 16. The upper edge **16*a* of the skirt portion 16 is provided with a plurality of circumferentially spaced, outwardly extending protuberances which form substantially rigid marginal locking lips 17. The number, size, shape and location of such lips may vary from that shown, if desired. Each lip has an under portion 17a thereof spaced from the underside of the ledge portion, see FIG. 4**.

The lower edge **16*b* of the skirt portion 16 may be enlarged or offset slightly outwardly so as to form a foot which may rest upon and be supported by a surface (e.g. table top, counter top, etc.). The height of the skirt portion is preferably the same, or slightly less than the extent to which the center section is recessed from a plane defined by the upper surface of the ledge portion 15. The skirt portion provides strength for the rim section 13 and also gives a more attractive and finished look to the tray 10**.

As aforementioned, the center section 12 in the illustrated embodiment of FIG. 1, is preferably recessed relative to the ledge portion 15 of the rim section 13. The outer periphery of the center section is delimited by an upstanding first wall 18 which may have an undulating or scalloped configuration. Wall 18 provides added strength for the center section; gives a decorative appearance to the tray; and interconnects the outer periphery of the center section with the inner periphery of the intermediate section 14.

The outer periphery of the intermediate section 14 is interconnected to the inner periphery of the ledge portion 15 of the rim section 13 by an upright second wall 19. The wall 19 may have an undulated or scalloped configuration which is complementary to the configuration of the first wall 18. The walls 18 and 19 are in concentric relation. Corresponding peaks or protrusions 18a, 19a formed in the exposed surfaces of the walls 18 and 19 may be interconnected by radially extending shallow ribs or struts 20 formed in the intermediate section 14.

The cover 11, which is illustrated as a dome cover is particularly suitable for use in covering such deli food, not shown, and includes a top section 21 which is elevated relative to the center section 12 of the tray on which the deli food is attractively arranged, so that when the cover is assembled on the tray, the top section will clear the top of the arranged food. The exposed surface of the top section may be planar or intagliosed with an attractive design.

The cover top section 21 is delimited by a depending wall section 22, the latter being provided with symmetrically arranged vertically extending stiffening ribs or flutes X. As seen in FIG. 2 the flutes may be defined by alternate inverted triangular furrows formed in the wall section. The depth of each furrow at one end is greater than at the opposite end. The lower edge of wall section 22 terminates in an outwardly projecting first flange 23, see FIG. 4, which abuts the ledge portion 15 of the tray, when the cover is locked in place on the tray as will be described more fully hereinafter. A second flange 24 extends downwardly and outwardly from the outer periphery of the first flange. The juncture between the first and second flanges defines a plurality of circumferentially spaced, inwardly facing pockets 25 which are sized and shaped so as to lockingly accommodate the tray marginal lips 17. The lower edge **24*a* of the second flange 24 may be offset outwardly a small amount as shown in FIG. 4**.

When the cover 11 is assembled on the tray 10, the pockets 25 and second flange 24 will snugly encompass, respectively, marginal lips 17 and skirt portion 16 of the tray 10. At the same time the first flange 23 rests upon, or abuts, the exposed surface of the tray ledge portion 15. Thus, the fluted wall 22 of the cover 11 is supported by the tray ledge portion. The offset lower edge **24*a* of the cover second flange will protrude outwardly a small amount from the lower edge 16b of the tray 10, see FIG. 4**.

The height and shape of the dome cover may vary from that shown without departing from the scope of the invention and will depend upon the configuration of the tray and/or the accommodated product. The shape and number of flutes or ribs X formed in the cover wall 22 may also vary from that shown.

To remove or disassemble the cover from the tray merely requires manually distorting outwardly a portion of the second flange 24 of the cover sufficiently as shown in phantom lines in FIG. 4 so that at least one pocket 25 is no longer in locking engagement with a lip 17. Outward distorting of the second flange is facilitated by the engaging the protruding lower edge **24*a* of the cover. Once the flange portion is distorted as shown in FIG. 4, a finger can be slipped between the distorted flange portion and the adjacent segment of the tray skirt portion and then moved around the exterior of the skirt portion whereupon the cover will automatically be cammed upwardly relative to the tray thereby releasing each marginal lip 17 from a corresponding pocket 25. Because of the thin gauge of the cover material, outward distortion of the second flange 24** can be accomplished with a small amount of manual effort.

FIGS. 6–8 illustrate a second embodiment 110 of the improved serving tray which differs from the tray 10 of FIG. 1, primarily, in the configuration of the center and intermediate sections 112 and 114. The center section 112 is recessed from a plane defined by the upper surface of the rim section 113 and has a cylindrical configuration. The intermediate section 114 includes a plurality of symmetrically arranged, upstanding ribs **114*a* which radiate from a collar portion 114*b*, the latter encompassing the center section 112. The radiating ribs 114*a* form the intermediate section 114 into a plurality of contiguous, individual recessed compartments K, which in the illustrated embodiment are of like configuration. The compartments are arranged about the center section. Tray 110 is particularly suitable for simultaneously accommodating and segregating a variety of comestible products (e.g. relish, olives, cheese, etc.). Each compartment K has a recessed bottom KB which may be substantially coplanar with center section 112. The outer and inner peripheral portions of the bottom KB may be defined by upstanding, scalloped or undulating walls 119 and 118**, respectively. The shape, size, depth, number and location of the compartments may vary from that shown, if desired.

As in the case of tray 10, the rim section 113 of tray 110 is provided with a substantially planar ledge portion 115 and a depending and outwardly extending skirt portion 116. The portions 115 and 116 cooperate to form a plurality of substantially rigid, circumferentially spaced, outwardly extending marginal locking lips 117. The lips 117 provide a ready means for lockingly engaging a cover in a manner as previously described.

As seen in FIGS. 7 and 8 the ribs **114*a* and collar portions 114*b*** are hollow or open on the underside thereof; thus, enabling corresponding ribs and collar portions of similar trays to interfit when the trays are stacked for storage or shipping. The hollow ribs and collar portion reduce the weight and cost of each tray without deleteriously affecting the strength, rigidity and appearance of the tray.

Thus, a tray and cover combination has been disclosed which is formed of thin gauge inexpensive plastic material, is a strong and stable structure, has an attractive appearance, and is capable of accommodating a wide variety of products.

We claim:

1. A food serving tray for use with a removable cover, said tray being formed of thin gauge material and comprising a center section, a rim section disposed in spaced encompassing relation with respect to said center section, and an intermediate section interconnecting said center and rim sections; said rim section including a ledge portion having an inner segment connected to the intermediate section, and a continuous skirt portion downwardly extending from an outer segment of the ledge portion, said skirt portion having upper edge segments spaced from the underside of said ledge portion and cooperating therewith to form a plurality of spaced, outwardly extending, substantially rigid marginal lips, each lip being adapted to be lockingly engaged by an encompassing yieldable peripheral segment of the cover when the tray and cover are in assembled relation.

2. The food serving tray of claim 1 wherein the center section is recessed from a plane defined by an upper surface of the ledge portion of said rim section.

3. The food serving tray of claim 1 wherein the skirt portion extends downwardly and outwardly from each of the lips.

4. The food serving tray of claim 1 wherein the lower edge of the skirt portion has an annular configuration and the marginal lips are substantially symmetrically arranged about the periphery of the rim section ledge portion.

5. The food serving tray of claim 2 wherein at least a portion of the recessed center section defines a plane in spaced substantially parallel relation with the plane defined by the upper surface of the ledge portion.

6. The food serving tray of claim 2 wherein the connection between the center and intermediate sections , defines an upright first wall encompassing the periphery of the center section.

7. The food serving tray of claim 2 wherein the connection between the rim and intermediate sections forms an upright wall substantially defining the periphery of the intermediate section.

8. The food serving tray of claim 6 wherein the connection between the rim and intermediate sections forms an upright second wall substantially encompassing the periphery of the intermediate section and in spaced substantially concentric relation with the upright first wall.

9. The food serving tray of claim 6 wherein the first wall has a tortuous surface configuration.

10. The food serving tray of claim 8 wherein the first and second walls have tortuous surface configurations.

11. The food serving tray of claim 9 wherein the intermediate section is provided with a plurality of protuberances interconnecting said first and second walls

12. The food serving tray of claim 8 wherein the first and second walls have substantially scalloped surface configurations.

13. The food serving tray of claim 6 wherein the intermediate section includes a plurality of upstanding, elongated ribs extending from said upright first wall encompassing the periphery of the center section said ribs cooperating with said upright first wall and rim section to form said intermediate section into a plurality of contiguous compartments arranged about the center section.

14. The food serving tray of claim 13 wherein said ribs and upright first wall are hollow and the ribs are substantially symmetrically arranged about said center section whereby corresponding ribs and upright first walls of similar trays will interfit when the trays are disposed in stacked relation.

15. A combination of a food serving tray and a cover removably mounted thereon, said tray formed of thin gauge material and including a center section, a rim section encompassing in spaced relation the periphery of said center section and an intermediate section interconnecting said center and rim sections, said rim section being provided with a ledge portion and a continuous skirt portion downwardly extending from an outer peripheral segment of the ledge portion, said skirt portion having upper edge segments spaced from the underside of said ledge portion and cooperating therewith to form a plurality of spaced, outwardly extending, substantially rigid marginal lips, said cover having a top section, an upright wall section connected to and depending from the periphery of said top section, said wall section having a lower edge terminating in a laterally extending outwardly projecting first flange, and a yieldable second flange encompassing said first flange and extending downwardly and outwardly therefrom, said second flange having portions thereof coacting with said first flange to form a plurality of pockets encompassing and lockingly accommodating the service tray lips when said tray and cover are in assembled relation, said second flange being adapted to encompass said tray skirt portion, and said cover first flange being adapted to abuttingly engage the tray ledge portion when said tray and cover are in assembled relation.

16. The combination of claim 15 wherein the cover wall section is provided with a plurality of upright flutes interconnecting the top section and the first flange.

17. The combination of claim 16 wherein the flutes formed in the cover wall section are defined by alternate inverted triangular furrows, the depth of each furrow being greater at one end than at the opposite end.

18. The food serving tray of claim 1 wherein the lower edge of the skirt portion has an annular configuration and the marginal lips are asymmetrically arranged about the periphery of the rim section ledge portion.

19. The food serving tray of claim 15 wherein the second flange of said cover is provided with a protruding lower edge member which is cammable upwardly and outwardly relative to said tray to release said cover from said tray.

20. The food serving tray of claim 19 wherein said tray skirt is provided with a lower edge, said lower support edge being spaced from said protruding lower edge member of said cover when said cover and tray are in an assembled relation.

* * * * *

UNITED STATES PATENT AND TRADEMARK OFFICE

CERTIFICATE OF CORRECTION

PATENT NO. : 4,874,083

DATED : October 17, 1989

INVENTOR(S) : Patricia A. Antoni et al.

It is certified that error appears in the above-identified patent and that said Letters Patent is hereby corrected as shown below:

On the cover page under "References Cited" the first reference "Re. 28059" should be --7/74-- instead of "6/74".

In Column 3, line 53, before "engaging" should be inserted --finger initially--.

In Column 5, line 8, "," should be deleted.

In Column 5, line 35, before "said" insert --;--.

In Column 5, line 47, after "tray" insert --being--.

In Column 6, line 18, change "service" to --serving--.

In Column 6, line 45, before "edge" insert --support--

Signed and Sealed this

Twenty-fifth Day of September, 1990

*Attest:*

HARRY F. MANBECK, JR.

*Attesting Officer*

*Commissioner of Patents and Trademarks*